US005327598A

United States Patent [19]

Liou

[11] Patent Number: 5,327,598

[45] Date of Patent: Jul. 12, 1994

[54] MASSAGE MATTRESS

[76] Inventor: Yaw T. Liou, P.O. Box 82-144, Taipei, Taiwan

[21] Appl. No.: 85,087

[22] Filed: Jul. 2, 1993

[51] Int. Cl.[5] ..... A47C 27/14

[52] U.S. Cl. ..... 5/481; 5/464

[58] Field of Search ..... 5/464, 481, 450, 468; 36/28, 71; 2/267

[56] References Cited

U.S. PATENT DOCUMENTS

| | | | |
|---|---|---|---|
| 2,192,601 | 3/1940 | Mattison | 5/481 X |
| 2,885,797 | 5/1959 | Chrencik | 36/28 X |
| 3,606,463 | 9/1971 | Brooks | 5/481 X |
| 3,984,926 | 10/1976 | Calderon | 36/71 X |

FOREIGN PATENT DOCUMENTS 549968 12/1957 Canada .

*Primary Examiner*—Michael F. Trettel

*Attorney, Agent, or Firm*—Alfred Lei

[57] ABSTRACT

This invention relates to an improved massage mattress and in particular to one including a body formed of foamed material and having a plurality of vertical through holes, and a plurality of emulsion members each solidified and formed integral with a corresponding one of the vertical through holes of the body, whereby the mattress may be easily cleaned and may provide natural and comfortable massage for the user standing or walking thereon.

1 Claim, 4 Drawing Sheets

MASSAGE MATTRESS

BACKGROUND OF THE INVENTION

It has been found that numerous massage mattresses have been provided in prior art that are either integrally formed of a single material (see FIG. 1A) or assembled by two members made of different materials (see FIG. 1B). Nevertheless, the former is difficult to be cleaned and the hardness thereof is uniform thereby rendering the massage monotonous, while the latter is also difficult to be cleaned and will be badly shaped after using in a short period of time.

Therefore, it is an object of the present invention to provide a massage mattress which may obviate and mitigate the above-mentioned drawbacks.

SUMMARY OF THE INVENTION

This invention relates to an improved massage mattress.

It is the primary object of the present invention to provide a massage mattress which has a flat surface when not subjected to pressure.

It is another object of the present invention to provide a massage mattress which is made of two different materials.

It is still another object of the present invention to provide a massage mattress which may be used to massage the sole of an user.

It is still another object of the present invention to provide a massage mattress which is easy to clean.

It is a further object of the present invention to provide a massage mattress which is durable in use.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1A:
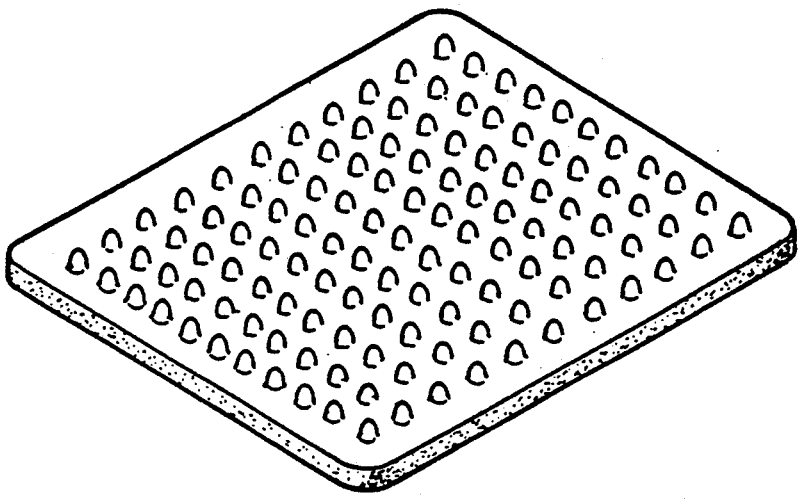
PRIOR ART FIG. 1A
FIG. 1A is a perspective view of a prior art mattress.
Figure 1B:
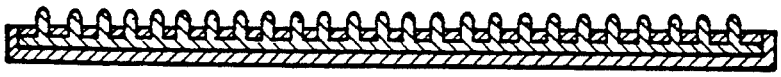
PRIOR ART FIG. 1B
FIG. 1B is a sectional view of the prior art mattress.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 2 thereof, the massage mattress 30 according to the present invention comprises a foamed body 10 and a plurality of solidified emulsion members 20. The body 10 is an integral body made of foamed material which will be easier to be deformed than the emulsion member 20. Further, the foamed body 10 is formed with a plurality of vertical through holes 11 which may be in the shape of a prism, cylinder, cone, etc.

Figure 2A:
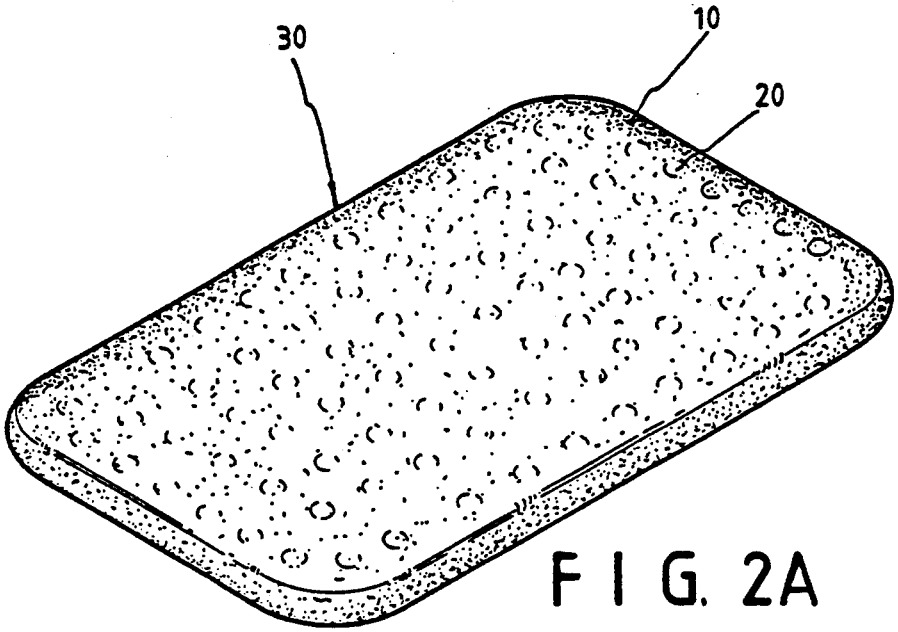
FIG. 2A is a perspective view of the present invention.
Figure 2B:
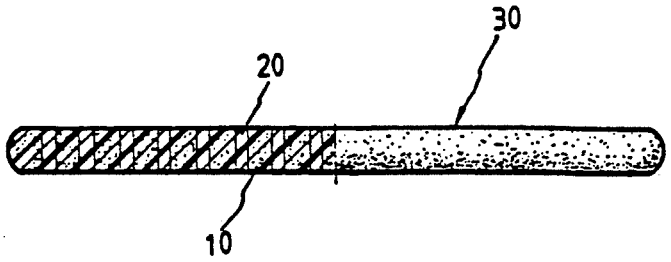
FIG. 2B is a sectional view of the present invention.
Figure 3:
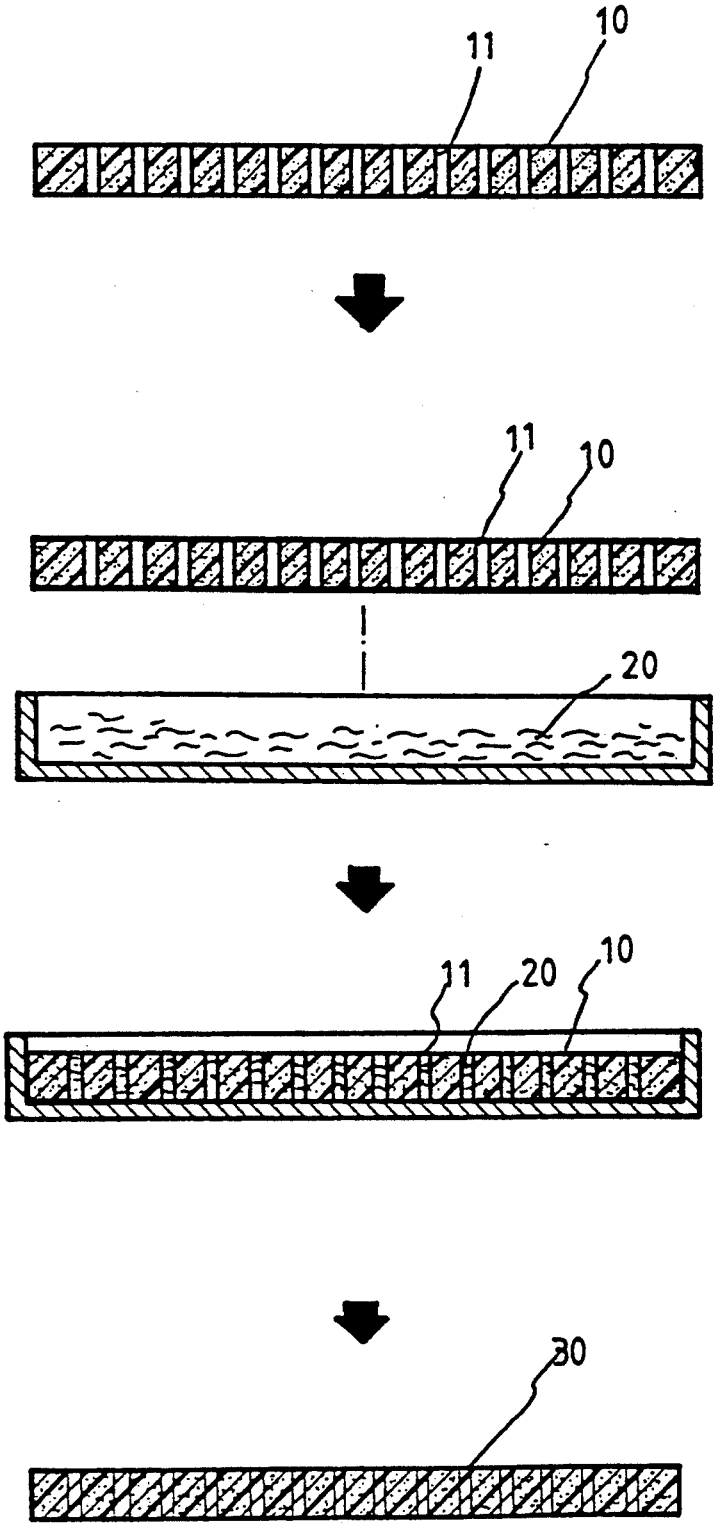
FIG. 3 shows the method to fabricate the present invention.
Figure 4:
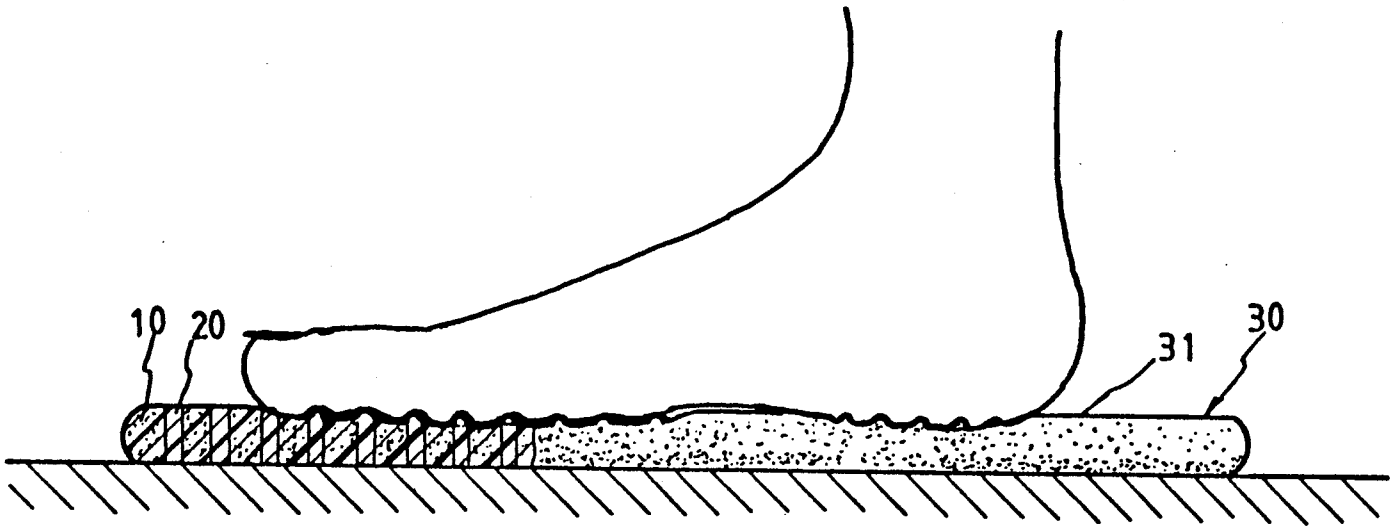
FIG. 4 shows an application of the present invention.

As shown in FIGS. 2A, 2B and 3, the foamed body 10 is first immersed into a tray containing liquid emulsion 20 so that the vertical through holes 11 of the foamed body 10 are filled with the liquid emulsion 20. Then, the liquid emulsion 20 is foamed by heating. Thus, the emulsion 20 in the vertical through holes 11 of the foamed body 10 will become hard and formed integral with the foamed body 10 thereby forming a one-piece mattress 30.

In conclusion, the present invention will have the following advantages:

1. The mattress has a flat surface when not subjected to pressure thus making it easier to be cleaned.

2. As the foamed body 10 is harder than the solidified emulsion member 20, a plurality of protuberances 20 will be formed on the top surface 31 of the mattress when subjected to pressure thus massaging the sole of an user standing thereon.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A massage mattress comprising:

a body formed of foamed material, having an upper flat surface and a lower flat surface, and provided with a plurality of vertical through holes; and a plurality of emulsion members each solidified and formed integral with a corresponding one of the vertical through holes of said body, said emulsion members having a top even with the upper flat surface of said body and a bottom even with the lower flat surface of said body.

* * * * *